United States Patent [19]

Poizot

[11] Patent Number: 5,071,379

[45] Date of Patent: Dec. 10, 1991

[54] FOAM PRODUCTION DEVICE

[76] Inventor: Francis Poizot, 71 Rue de Seresnes, 92380 Garches, France

[21] Appl. No.: 458,946

[22] Filed: Dec. 29, 1989

[30] Foreign Application Priority Data

Jan. 3, 1989 [FR] France ..... 89 00016

[51] Int. Cl.[5] ..... B67D 5/60

[52] U.S. Cl. ..... 222/464; 210/493.1; 239/343

[58] Field of Search ..... 222/190, 464, 211, 382, 222/383, 385; 239/327, 343, 333, 428.5, 323; 210/493.1, 493.5

[56] References Cited

U.S. PATENT DOCUMENTS

| | | | |
|---|---|---|---|
| 3,985,271 | 10/1976 | Gardner | 222/211 X |
| 4,019,657 | 4/1977 | Spitzer et al. | 222/190 |
| 4,027,789 | 6/1977 | Dickey | 222/190 |
| 4,042,217 | 8/1977 | Snider et al. | 222/190 |
| 4,151,095 | 4/1979 | Wright | 210/493.5 X |
| 4,219,159 | 8/1980 | Wesner | 239/343 |
| 4,836,422 | 6/1989 | Rosenberg | 222/190 |
| 4,993,599 | 2/1991 | Gruenewald | 222/190 |

FOREIGN PATENT DOCUMENTS

| | | | |
|---|---|---|---|
| 268733 | 12/1965 | Australia | 239/343 |
| 2024049 | 1/1980 | United Kingdom | 239/343 |

*Primary Examiner*—Andres Kashinkow
*Assistant Examiner*—Lesley Morris
*Attorney, Agent, or Firm*—Ostrolenk, Faber, Gerb & Soffen

[57] ABSTRACT

A foam producing device is disclosed which can be fitted to the liquid duct (3) of a liquid dispenser appliance, comprising at least one chamber (4) whose cross section is preferably greater than that of the liquid duct and which is placed in the duct and is divided into compartments (5, 6, 7) by at least one dividing wall (8) which is porous or has fine perforations, the chamber being in communication (9) with the atmospheric air on an air source.

38 Claims, 1 Drawing Sheet

FOAM PRODUCTION DEVICE

BACKGROUND OF THE INVENTION

The invention relates to a device to be incorporated in a liquid dispensing appliance for dispensing liquid in the form of foam.

Numerous applications are known in which it is desirable to dispense a liquid product in the form of a foam, for different reasons. In particular, the foam remains durably in contact with the surface to be treated by the product and the action of the foam is therefore more efficient, the distribution and spreading of the product are easier to control, contact with the skin is lighter and more pleasant in the case of toilet products, etc. Of course, the product is stored in a container in liquid form and the means which control the ejection of the liquid must then be completed by a device transforming the liquid into foam.

Such foaming devices are known and they generally comprise a liquid flow dividing member and an air intake. However, these devices, especially when they are intended for hand actuated appliances without an auxiliary driving gas, such as dispensers for soap, shampoo, household products or different cosmetics, have drawbacks. In general the liquid ejection means generate a pulsed flow, for example in the case of an alternating positive displacement pump or compression/depression of a deformable wall of a container. These known foaming devices are sensitive to such flow variations and that causes variations in the quality of the foam, depending on the stroke and the rate of operating said ejection means. Moreover, the foam is often non-existent during the first pulsations, because the device is unprimed when inoperative. Other foaming devices comprise mobile elements, such as balls or valves of various shapes, but that increases the price of the device and the risks of malfunction.

In a new way, the present invention avoids the above drawbacks.

The object of the invention is then to provide a foam forming device, mainly for a dispenser appliance whose liquid ejection means may be actuated by hand, which ensures the immediate production of foam of constant and excellent quality, while being extremely simple and economic to produce.

Another object of the invention is to provide a foaming device which can be readily incorporated directly in the liquid duct of a liquid dispenser of any known type.

A further object of the invention is a foaming device which does not require any mobile element and in which even the mobile valve of the dispensing apparatus may be omitted, if it has one, without resulting in unpriming, or leaking or dripping on the outside.

BRIEF DESCRIPTION OF THE INVENTION

The foaming device of the invention is of the type in which, in a container for the liquid to be foamed, a duct serves for feeding the liquid into a porous material in which air arrives at the same time and the foam formed is discharged from the top of the container, downstream of the porous material; it is characterized in that the liquid duct is extended, in the direction of the outlet of the container, through at least one chamber divided by one or more transverse dividing walls made from a material which is porous or has fine perforations, this chamber being in communication with the atmospheric air or with a gas reserve, for example with a compressed air reservoir.

Depending on the nature of the liquid to be foamed, particularly its viscosity, and in relation with the desired pressure and flow for ejection of the foam, the ratio of the sections of the liquid duct and the chamber may be chosen between very wide limits. For current practice, the cross section of the chamber may for example be equal to 1 to 200 times that of the liquid feed duct; it is very often 5 to 30 times that of the duct. In the case of circular sections, the diameter D of the chamber may represent 1 to 30 times the diameter of the duct which it extends. Very often, the ratio D/d is about 2 to 6, and especially for small dispensers.

Of course, the container of the device of the invention may comprise several liquid ducts and/or several foaming chambers divided into compartments. Thus, a single branched duct may feed several chambers with liquid, the chambers, for example, being disposed radially about the vertical axis of the container; or else a large diameter chamber may receive the liquid to be foamed from several liquid feed ducts. Such multiple arrangements overcome clogging troubles, thus ensuring more reliable operation.

The cross sections of the foaming chamber or chambers and of the liquid duct or ducts have no particular limit in absolute value; in fact, although chambers of a section of from 10 to 1000 $mm^2$ are suitable for small foam devices, including pocket appliances, the chambers of large industrial appliances, for the production of large amounts of foam, may have a section of 1 $m^2$ or more. By way of example, chambers with a section of about 176 to 625 $cm^2$, i.e. having a diameter from 15 to 50 cm, are suitable for producing foam for extinguishing fires.

Communication of the foaming chamber with the atmosphere or with an air reserve or—if such be the case —another gas, may be provided by any means known in the art. It may be achieved particularly by providing one or more orifices in the wall of the chamber, when the latter is in the gas phase of the container which contains it. Communication with the air may also be achieved by means of one or more ducts connecting the inside of the chamber with the air source or other gas. In the case of extinguishers, an embodiment of the invention consists in using a liquid $CO_2$ tank as gas source.

The porous or multi-perforated dividing walls separating the inner space of the foaming chamber into several compartments may be placed horizontally or obliquely with respect to the vertical axis of the chamber; thickness can be for example 0.05–5 mm, preferably 0.1 to 2 mm.

Among the numerous materials with pores or channels, well known in industry and used as filters or gas or liquid dispensers, those which are the most suitable for the preparation of a given foam are chosen for the device of the invention. The choice is vast between cloths, metal, textile, plastic, cellulose, glass or porcelain sieves. Although metal sieves are preferred, because of their mechanical strength, for high foam rates, possibly at more or less high pressures, porous dividing walls made from plastic, textile and particularly cellulose materials are generally suitable for small or medium sized devices, in particular for domestic and toilet use.

The passages or pores of the dividing walls are fairly small so that the capillarity effect or surface tension of the liquid prevents unpriming of the duct and external dripping when inoperative.

The dimensions of these pores or channels, in the dividing walls used, play a role in obtaining foam of the desired quality. In general, the size of these passages or openings in the mesh of the sieves varies widely, for example from about 10 microns up to beyond 250 microns and the dividing walls very often have passages or openings of about 50 to 150 microns. The dimensions of the pores or passages are chosen all the higher the higher the viscosity of the liquid used. Excellent results are obtained in small toilet appliances with pores of about 80 to 120 microns.

To the advantages of stability, reliability and ease of operation, in accordance with the invention is added the possibility of obtaining, as desired, foams with more or less fine cellular structure, and more or less "dry" or "wet". These qualities may be adjusted by the number of transverse foaming devices, placed in series in the foaming chamber, through which the liquid and the foam pass before reaching the output of the device. The foam obtained, after passing through a first porous dividing wall or filtering grid, may be further improved by passing through one or more successive dividing walls. The total number of the latter may vary and it depends moreover on the fineness of the pores or channels. For current practice, 1 to 5 dividing walls are generally sufficient depending on the nature of the liquids processed and the desired quality of the foams; 2 or 3 dividing walls are very often suitable for domestic purposes.

In a particular embodiment of the invention, the refinement of a foam, its "dryness" or on the contrary "wetness" are obtained by using dividing walls with different fineness of pores or canals. Thus, a first dividing wall may be provided with relatively wide openings, for example about 120 microns, a second at about 90 microns and a third not exceeding 70 microns. Depending on the nature of the liquids to be foamed, the surfactants used and the desired quality of the foam, it may be advantageous to have the finest pores in the first dividing wall and larger and larger ones in the following walls.

When the device of the invention comprises several transverse dividing walls, dividing the chamber into more than two compartments, communication with the air or gas source must be established so as to have a pressure balance in all compartments. For that, one, several or all these compartments are connected to the gas phase of the device.

When the preparation of a foam extends over a fairly long time and relates to more or less large amounts, the container of the device of the invention is connected to a reservoir from which it is fed continuously or intermittently with liquid.

BRIEF DESCRIPTION OF THE DRAWINGS

The invention will be better understood from the following detailed description given by way of example of some of its embodiments, shown in the accompanying drawings.

DETAILED DESCRIPTION OF THE PREFERRED EMBODIMENT

Figure 1:
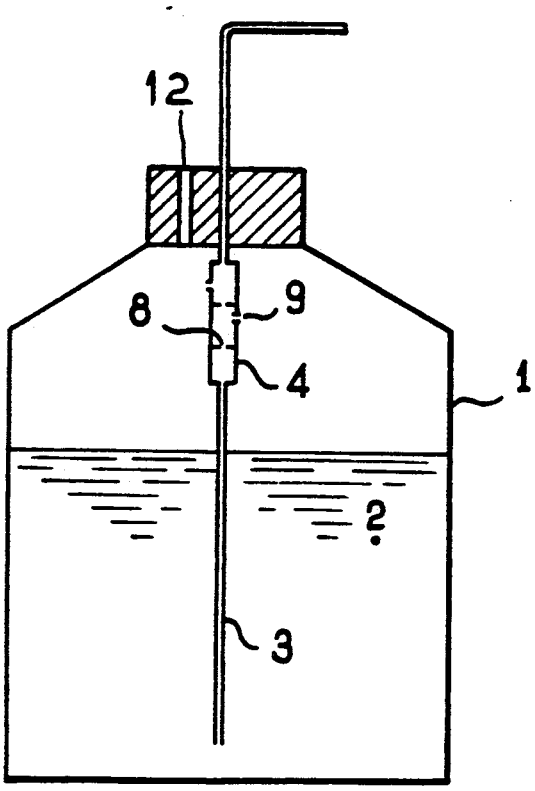
FIG. 1 is a diagram of the foaming device of the invention adapted to a flask with deformable walls.
Figure 3:
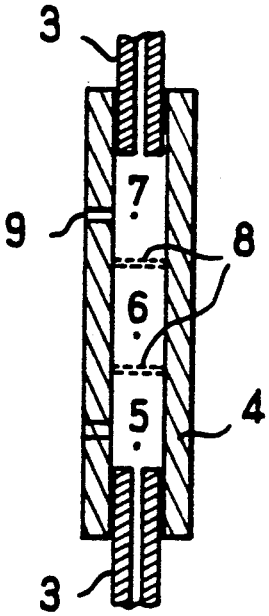
FIG. 3 is an enlarged view of the device of FIG. 1, in its simplest embodiment.

FIG. 1 shows a container or flask with a deformable wall 1 containing a liquid 2 such as soap, shampoo, a cleaning product or similar liquid, having surface tension characteristic which permits it to foam. Compression of the wall 1 drives a certain amount of liquid 2 outside of the container, through a duct 3 and release of the wall 1 causes a return of air to replace the expelled liquid. A foaming device in accordance with the invention is inserted in the duct 3, below the stopper of the container. This device comprises a chamber 4, having a cross section larger than that of the duct 3, which, is best shown in FIG. 3, is divided into three compartments 5, 6 and 7 by two transverse dividing walls 8. The wall of chamber 4 is formed with a small hole 9 which communicates with the air space in the upper part of the container 1. A closable conduit 12 can be provided in the stopper for feeding the container continuously or intermittently with the liquid to be foamed.

The dividing walls 8 are formed by a sieve or porous membrane made from any material appropriate for the liquid dispensed. The orifices or pores of the dividing walls 8 have a unitary dimension such that the liquid 2 passing through them is finely divided and forms a very stable foam with the air which penetrates at the same time into the compartment 7 through orifice 9. Furthermore, this dimension of the elementary passages is fairly small so that, by surface tension effect, the foam formed is substantially retained on the dividing walls 8 and therefore in compartment 6, during decompression of the container 1. As a result the device rapidly delivers the foam at the time of the next use, even after a prolonged period of non-use. This is very advantageous both from the point of view of pleasure in use and from the economic point of view.

The total flow section of the dividing wall 8 is determined as a function of the mean flow rate to be obtained. If the flow rate tends to increase, for example because wall 1 is deformed too abruptly, the pressure loss through the small orifices increases very quickly and limits the maximum liquid flow, so that the foam remains of substantially constant quality, which is another advantage of the device.

In a practical embodiment, used for dispensing liquid soap, the transverse dividing wall 8 was a sheet of non woven cellulose fibres with passages of 95 microns and the cross section of chamber 4 represented about 20 times that of duct 3 thickness of the sheet 0.12 mm.

Figure 2:
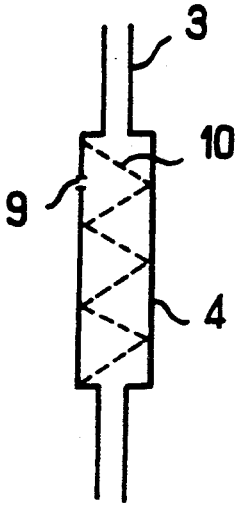
FIG. 2 illustrates a dividing wall formed by folding a ribbon concertina fashion.

FIGS. 2 and 3 illustrate advantageous embodiments of the device of the invention. In FIG. 2, the dividing walls are formed by a strip 10 folded in concertina fashion, which defines a plurality of successive compartments and facilitates the positioning and maintenance of the position of the dividing wall. FIG. 3 illustrates a very simple embodiment of the device, in which chamber 4 is defined by cutting tube 3, moving the ends of this tube away from each other and connecting these two portions together via a tube 4 whose inner diameter corresponds to the outer diameter of tube 3 and in which dividing walls 8 are embedded.

Figure 4:
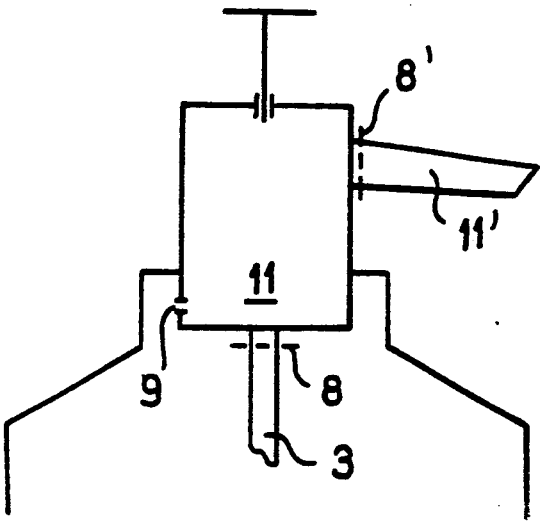
FIG. 4 is a diagram of the foaming device of the invention adapted to a container having a hand pump.

FIG. 4 illustrates the device fitted to a container having a non deformable wall but having a hand pump. In this case, the body of the pump itself forms a chamber 11 provided with an air intake 9 and it is sufficient to insert the perforated or porous dividing walls 8 at the inlet of the pump body. In addition, because of the presence of the dividing walls, a pump ball or valve may be omitted if desired, which is an additional advantage of the device in this case.

More than one chamber may be disposed in the duct. In particular, in the case of the pump appliance of FIG. 4, a dividing wall 8' may also be placed in front of the output nozzle which then forms another chamber 11'.

By way of non limitative example, the transverse dividing walls of the devices described may be formed by a sieve or porous element, having an orifice or pore size of about 100 microns, particularly from 80 to 120 microns.

The cross section of chamber 4 is preferably between 5 and 30 times that of duct 3.

The device of the invention is placed inside or outside the appliance: the chamber is added (4) or pre-existing (11, 11') in the appliance, the air intake 9 being also created or pre-existing. It may further comprise several successive chambers.

In the application of the device of the invention to a compressible dispenser flask, the device is placed in the top part of the plunger, inside the flask, at the base of the stopper, the movement of the liquid being created by pressure on the flask. If the device is applied to an incompressible container having a pump, it is placed on the suction and/or delivery side of the pump, the chamber of the device being formed by the pump body and/or the nozzle at the output of the pump; the porous dividing wall then also preferably fulfils the function of valve of the pump.

Of course, modifications of detail may be made to the form and construction of the device of the invention, without departing from the scope and spirit of thereof.

I claim:

1. Device for the formation of foam, said device comprising:

a container having a hollow space for holding a foamable liquid;

a foam outlet coupled to said container through which foam formed in said container is discharged;

a duct located in said container and extending from said hollow space to said foam outlet, said duct defining a liquid flow path through which said liquid travels from said hollow space to said foam outlet;

a foam forming chamber located in said duct and including upstream and downstream thin porous walls which are spaced apart from one another to define said foam forming chamber, each of said porous walls having a plurality of small porous openings formed therein;

means for introducing gas into said form forming chamber and simultaneously causing said foamable liquid to enter said chamber through said upstream wall, said porous openings in said porous wall agitating said foamable liquid as it passes through said upstream wall, said agitated liquid combining with said gas to create a liquid foam in said chamber.

2. Device according to claim 1 in which the porosity of said porous walls is such that said foamable liquid will not pass through said walls under the pressure of gravity.

3. Device according to claim 2 in which said porous walls have a thickness of 0.05 to 5 mm and pores of about 10 to 250 microns.

4. Device according to claim 1 in which said porous walls are defined by respective sections of a porous ribbon folded in the form of a concertina so as to form a plurality of foam forming chambers within said duct.

5. Device according to claim 4 in which the porosity of said walls is such that liquid will not pass through said walls under the pressure of gravity.

6. Device according to claim 1 in which the cross section of said chamber is between 1 and 200 times the cross section of said duct adjacent said chamber.

7. Device according to claim 1 in which the porosity of said upstream wall is different from the porosity of said downstream wall.

8. Device according to claim 7 in which each of said walls has a thickness of 0.05 to 5 mm and pores of about 10 to 250 microns.

9. Device according to claim 7 in which the porosity of at least one of said walls is such that liquid will not pass through said wall under the pressure of gravity.

10. Device according to claim 1 further including means for feeding the container continuously with the liquid to be foamed.

11. Device according to claim 1 in which said container comprises a compressable dispenser flask and in which said foam forming chamber is disposed near said foam outlet.

12. Device according to claim 1 in which said container comprises an incompressable container having a pump for imposing pressure on said foamable liquid within said container.

13. Device according to claim 1 further including means for feeding the container intermittently with the liquid to be foamed.

14. Device according to claim 1, wherein said duct defines the sole path for said foamable liquid to travel from said hollow space to said foam outlet.

15. Device according to claim 16, wherein said foam outlet is removably coupled to said container.

16. Device according to claim 16, wherein said openings in said upstream porous wall define the sole path for said foamable liquid to travel through said duct from a position upstream of said upstream wall into said foam forming chamber.

17. Device according to claim 16, wherein said openings in said downstream porous wall define the sole path for said foamable liquid to travel through said duct from said foam forming chamber to a position downstream of said downstream porous wall.

18. Device according to claim 1, wherein said openings in upstream porous wall define the sole path for said foamable liquid to travel through said duct from a position upstream of said upstream wall into said foam forming chamber.

19. Device according to claim 18, wherein said openings in said downstream porous wall define the sole path for said foamable liquid to travel through said duct from said foam forming chamber to a position downstream of said downstream porous wall.

20. Device of claim 1, wherein said foam forming chamber is located in said hollow space of said container.

21. Device of claim 1, wherein porous walls extend generally transverse to said liquid flow path.

22. A device for the formation of foam, said device comprising:

a container having a hollow space for holding a foam forming liquid;

a foam outlet coupled to said container through which foam formed in said container is discharged;

a duct located in said container and extending from said hollow space to said foam outlet, said duct defining a liquid flow path through which said liquid travels from said hollow space to said foam outlet;

a plurality of foam forming chambers located in said duct, each of said chambers including upstream and downstream thin porous walls which are spaced apart from one another to define said foam forming chambers, each of said porous walls having a plurality of small porous openings formed therein;

means for introducing gas into said foam forming chambers and simultaneously causing said foamable liquid to enter each of said chambers through its respective said upstream wall, said porous openings in said respective upstream walls agitating said foamable liquid as it passes through said respective upstream walls, said agitated liquid combined with said gas to create liquid foam in said chambers.

23. The device of claim 22, wherein said chambers are located adjacent one another and wherein said upstream wall of one of said chambers defines said downstream wall of an immediately adjacent said chamber.

24. The device of claim 23, in which the porosity of said porous walls is such that said permeable liquid will not pass through said walls under the pressure of gravity.

25. The device according to claim 24, in which said porous walls have a thickness of 0.05 to 5 mm and pores of about 10 to 250 microns.

26. The device according to claim 22, in which said porous walls are defined by respective sections of a porous ribbon folded in the form of a concertina so as to define said plurality of form forming chambers.

27. The device according to claim 26, in which the porosity of said walls is such that liquid will not pass through said walls under the pressure of gravity.

28. The device according to claim 22, in which the cross section of said chambers is between 1 and 200 times the cross sections of said duct adjacent said chambers.

29. The device according to claim 22, in which the porosity of said upstream wall of said chambers is different than the porosity of said downstream wall of said chambers.

30. The device according to claim 29, in which each of said walls has a thickness of 0.05 to 5 mm and pores of about 10 to 250 microns.

31. The device according to claim 29, in which the porosity of at least one of said walls is such that liquid will not pass through said wall under the pressure of gravity.

32. The device according to claim 22, wherein said duct define the sole path for said foamable liquid to travel from said hollow space to said foam outlet.

33. The device according to claim 32, wherein said foam outlet is removably coupled to said container.

34. The device according to claim 32, wherein said openings in said upstream porous walls define the sole path for said foamable liquid to travel through said duct from a position upstream of said upstream wall into the associated said foam forming chamber.

35. The device according to claim 34, wherein said openings in said downstream porous walls define the sole path for said foamable liquid to travel through said duct from each said foam forming chamber to a position downstream of its respective downstream porous wall.

36. The device according to claim 22, wherein said openings in said upstream porous walls define the sole path of said foamable liquid to travel through said duct from a position upstream of said upstream wall into its respective said foam forming chamber.

37. The device according to claim 36, wherein said openings in said downstream porous wall define the sole path for said foamable liquid to travel through said duct from each said foam forming chamber to a position downstream of its associated downstream porous wall.

38. The device of claim 22, wherein said foam forming chamber is located in said hollow space of said container.

* * * * *